US005146910A

United States Patent [19]

Grahl et al.

[11] Patent Number: 5,146,910

[45] Date of Patent: Sep. 15, 1992

[54] NOX REDUCING DEVICE FOR FUEL-FIRED HEATING APPLIANCES

[75] Inventors: Keith M. Grahl; Larry R. Mullens, both of Fort Smith, Ark.

[73] Assignee: Rheem Manufacturing Company, New York, N.Y.

[21] Appl. No.: 732,502

[22] Filed: Jul. 18, 1991

[51] Int. Cl.[5] ..... F24H 3/02

[52] U.S. Cl. ..... 126/110 R; 165/109.1; 138/38

[58] Field of Search ..... 126/110 R; 165/177, 165/179, 109.1; 138/37, 38, 39

[56] References Cited

U.S. PATENT DOCUMENTS

| | | | |
|---|---|---|---|
| 940,542 | 11/1909 | Mathews | 138/38 |
| 1,056,373 | 3/1913 | Segelken | 165/177 X |
| 2,034,822 | 3/1936 | Morrow | 138/38 |
| 4,106,558 | 8/1978 | Neveux | 165/109.1 |
| 4,179,222 | 12/1979 | Strom et al. | 138/38 X |
| 4,729,207 | 3/1988 | Dempsey et al. | 126/110 R X |
| 4,790,268 | 12/1988 | Eising | 126/350 R X |

FOREIGN PATENT DOCUMENTS

| | | | |
|---|---|---|---|
| 1009973 | 11/1965 | United Kingdom | 165/109.1 |

*Primary Examiner*—Larry Jones

*Attorney, Agent, or Firm*—Konneker & Bush

[57] ABSTRACT

Elongated metal devices are coaxially inserted into, and closely received within, inlet end portions of the heat exchanger combustor tubes of a fuel-fired heating appliance, representatively a forced air heating furnace. The inserted devices function to substantially reduce the $NO_x$ content of the combustion gases ultimately discharged from the furnace by intercepting, dispersing, and thermally quenching the burner flames drawn through the combustor tubes by a draft inducer fan portion of the furnace. Each device is formed by a pair of elongated, generally rectangular slotted metal plate members which are longitudinally overlapped and transversely secured to one another in a manner providing the device with a generally cross-shaped cross section along its length. Elongated slots are formed in the four outer side edges of the device for operational sound reduction purposes. An alternate embodiment of the device is formed by welding together two elongated metal members each having an L-shaped cross section. Due to the cross-sectional configurations of the devices, they perform their $NO_x$ reducing functions without generating an appreciable amount of noise during operation of their associated furnace. The improved furnace is accordingly suitable for indoor residential installations. The devices may also be incorporated in the combustor tubes of other types of fuel-fired heating appliances such as water heaters and boilers.

9 Claims, 3 Drawing Sheets

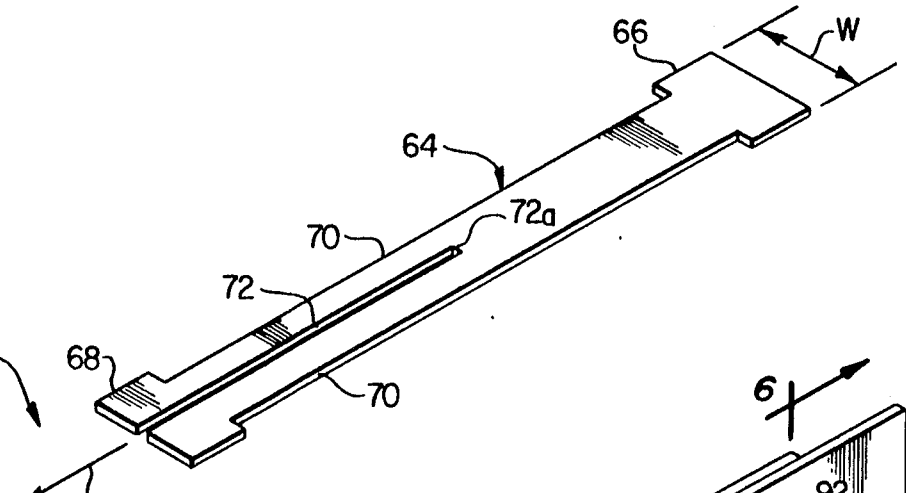
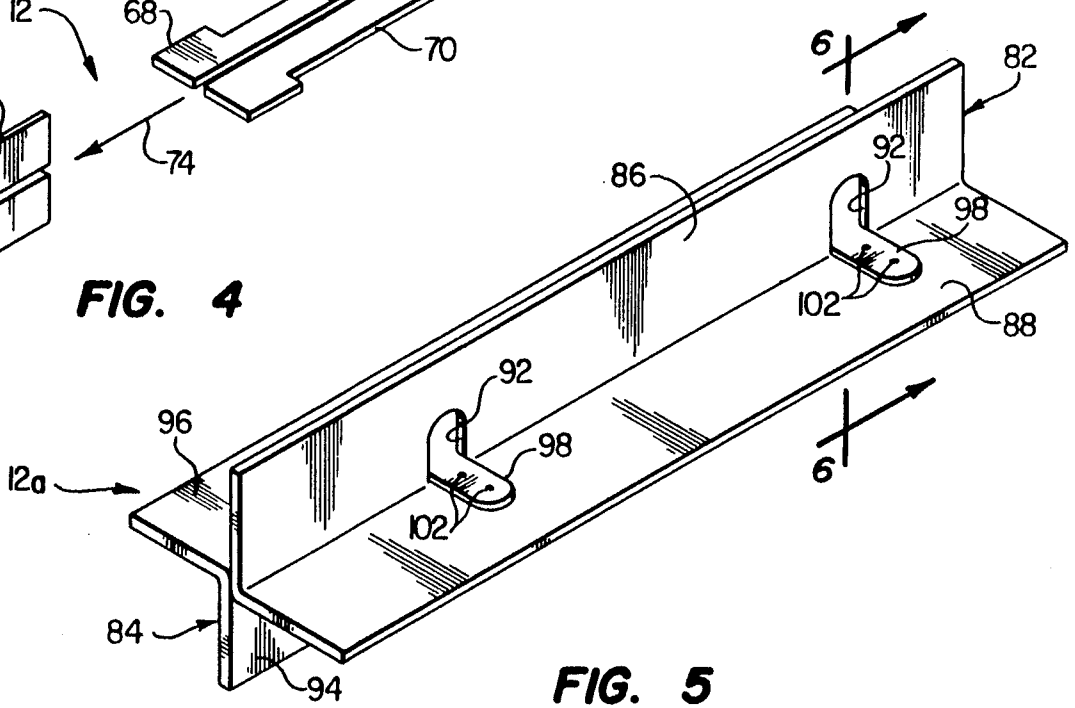
FIG. 5
FIG. 4
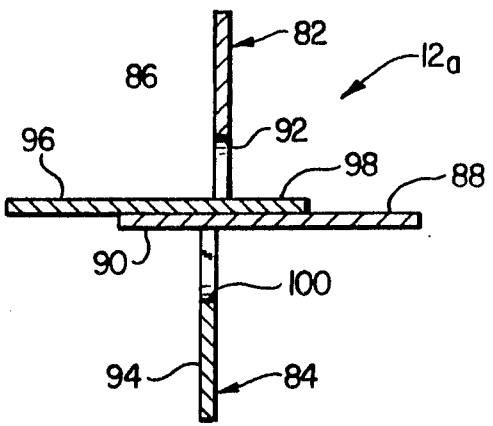
FIG. 6
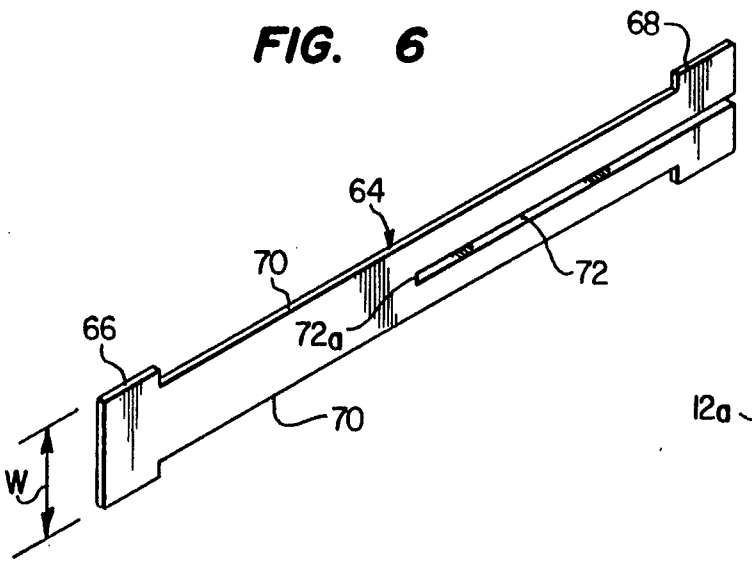

NOX REDUCING DEVICE FOR FUEL-FIRED HEATING APPLIANCES

BACKGROUND OF THE INVENTION

The present invention generally relates to fuel-fired heating appliances, such as forced air furnaces, water heaters and boilers, and more particularly relates to apparatus and methods for reducing the $NO_x$ emissions thereof.

Combustion products formed during the operation of gas-fired heating appliances such as forced air furnaces, water heaters and boilers typically contain $NO_x$ (oxides of nitrogen) which may undesirably be discharged to atmosphere. $NO_x$ is produced by the oxidation of atmospheric nitrogen in high temperature regions of the burner flames. The process is endothermic (i.e., temperature dependent), and typically proceeds at significant rates only at temperatures above about 1800° F.

In forced draft gas-fired heating appliances using shot-type burners, the burner flames (and resultant hot combustion gases) are drawn through heat exchanger combustor tubes at a relatively high velocity by a draft inducer fan which ultimately discharges the spent combustion gases to atmosphere. The medium to be heated by the appliance (air in the case of a furnace, and water in the case of a water heater or boiler) is flowed externally across the heat exchanger structure which transfers combustion heat thereto.

In order to reduce the amount of $NO_x$ formed during the combustion process, the burner flames must be "quenched" (i.e., reduced in temperature). One method of accomplishing this flame quenching is to insert a "heat sink" member into the flame path to absorb a portion of its heat energy, thereby reducing its temperature and corresponding $NO_x$ levels. It is also possible to cool the flame by dispersing it, causing it to lose its "tight" pattern and become somewhat disorganized. The resulting random or unconcentrated flame is cooler than the formed flame, also resulting in lowered $NO_x$ levels.

Conventionally configured thermally conductive heat sink members interposed in the flame path for quenching purposes also tend to disrupt and disperse the flame, thereby lowering the level of $NO_x$ generation by each of these two mechanisms. However, particularly in the case of forced draft heating appliances using shot-type burners in combination with tube-type heat exchanger structures, conventionally configured heat sink members tend to generate excessive a mounts of operational noise while performing their $NO_x$ reducing functions. Forced draft heating appliances provided with these conventionally configured heat sink members thus typically tend to be unsuitable for indoor residential installations where quietness of operation is a primary design consideration.

It can be seen from the foregoing that it would be desirable to provide a $NO_x$ reducing heat sink device that is sufficiently quiet in operation to permit its associated appliance to be used in indoor residential installations. It is accordingly an object of the present invention to provide such a device.

SUMMARY OF THE INVENTION

In carrying out principles of the present invention in accordance with a preferred embodiment thereof, a fuel-fired heating appliance, representatively a forced air heating furnace, is provided with a heat exchanger comprising a generally tubular combustor member having a first longitudinal portion circumscribing an axis and adapted to internally receive a flame through an outer end thereof, and a second longitudinal portion adapted to discharge combustion gases, generated by the received flame, through an outer end thereof.

Uniquely configured $NO_x$ reducing means are disposed within and extend axially along the first longitudinal combustor member portion, and function in a very quiet manner to reduce the $NO_x$ level of the discharged combustion gases by intercepting, dispersing and thermally quenching the received flame. The $NO_x$ reducing means are operative along their axial length to divide the interior of the first longitudinal combustor member portion, along generally planar boundary surfaces extending radially outwardly from the combustor member axis, into a plurality of circumferential segments.

The $NO_x$ reducing means have a relatively thin leading edge portion configured and positioned to initially intercept the received flame with a minimal disruption thereof. During operation of the heating appliance, the received flame is divided into a plurality of separated portions which flow axially through the aforementioned circumferential segments formed within the combustor tube by the $NO_x$ reducing means. Due to their specially designed configuration and operation, the $NO_x$ reducing means of the present invention are capable of reducing $NO_x$ emissions to an acceptable level without creating an appreciable degree of increased noise within the combustor tube during operation of the appliance.

In a preferred embodiment thereof, the $NO_x$ reducing means are formed from two longitudinally overlapping elongated metal plate members transversely secured to one another in a manner providing the device with a generally cross-shaped configuration along its length. The two plate members are laterally configured in a manner such that, with the device axially inserted into the combustor tube, the outer side edges of the plate members are in a press-fit relationship with the interior surface of the combustor tube. According to a feature of the invention, these outer side edges of the $NO_x$ reducing device are provided with elongated notches, positioned between outer end sections thereof, to enhance the operational quietness of the device.

An alternate embodiment of the $NO_x$ reducing device includes first and second elongated bent plate members each having a generally L-shaped cross section along its length defined by a pair of transverse leg portions, a spaced plurality of outwardly projecting tabs, and a spaced plurality of openings formed through one of the leg portions adjacent the tabs. The plate members are in a parallel relationship with the tabs of each plate member extending through the openings in the other plate member, and means are provided for securing the tabs of each plate member to the other plate member. This embodiment of the $NO_x$ reducing device is laterally sized to be relatively loosely received within its associated combustor tube portion.

The cross-sectional symmetry of the device, in either of its illustrative embodiments, permits it to be inserted into its associated combustor tube in any radial orientation and still effectively reduce $NO_x$ emissions. The device is of a very simple design, is relatively inexpensive to manufacture, and it easy to install in its associated combustor tube. While the device is illustratively incorporated in a furnace, it will be readily appreciated by those skilled in this are that it could also be used to advantage in the combustor tubes of other types of fuel-fired heating appliances such as, for example, water heaters and boilers.

BRIEF DESCRIPTION OF THE DRAWINGS

FIG. 4 is an enlarged scale exploded perspective view of the FIG. 3 $NO_x$ reducing device;

FIG. 5 is a perspective view of an alternative embodiment of the $NO_x$ reducing device; and FIG. 6 is an enlarged scale cross-sectional view taken through the $NO_x$ reducing device along line 6—6 of FIG. 5.

DETAILED DESCRIPTION

Figure 1:
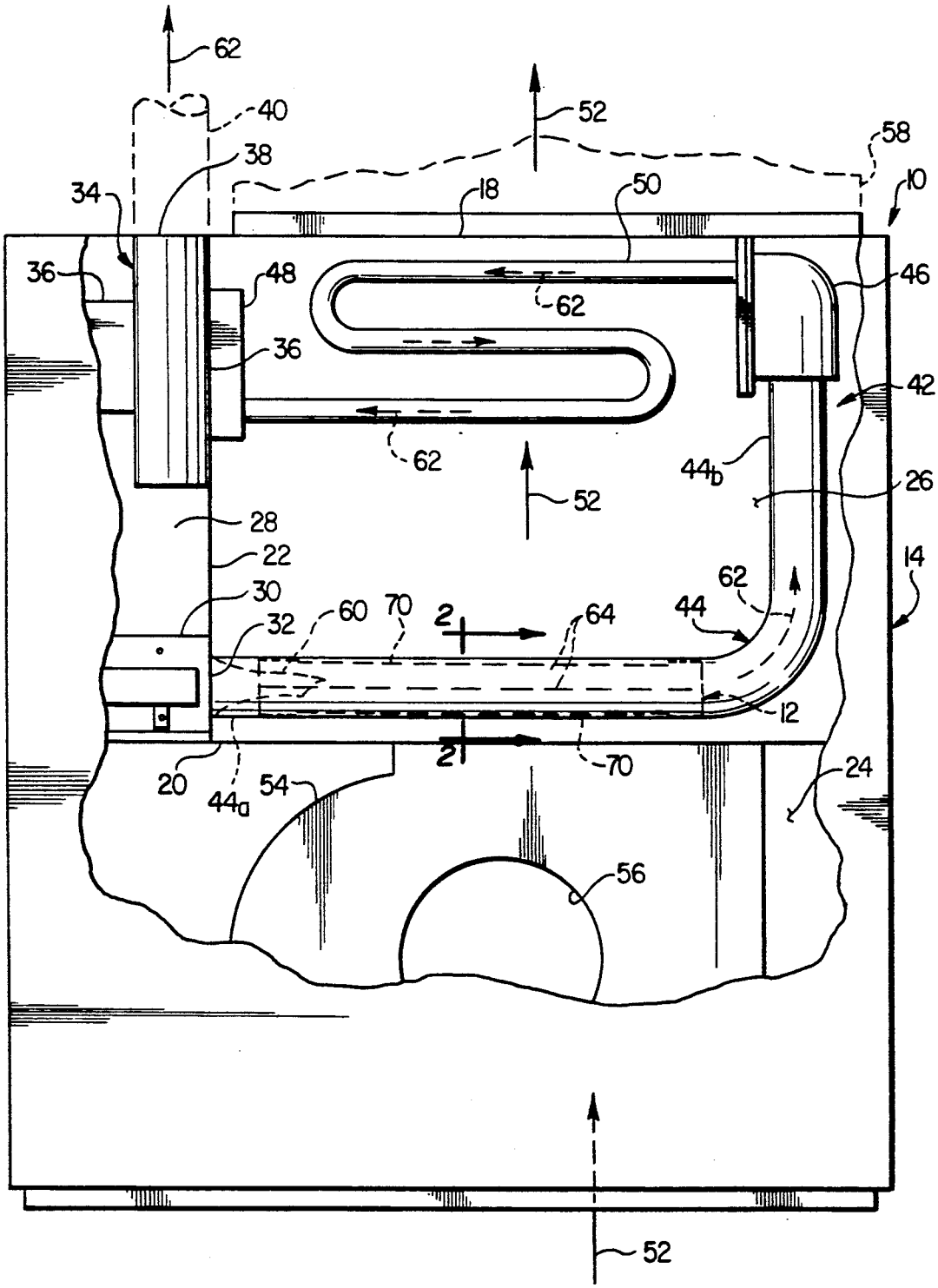
FIG. 1 is a somewhat simplified, partially cut away side elevational view of a representative gas-fired forced air heating furnace having incorporated therein a series of $NO_x$ reducing devices embodying principles of the present invention.

Illustrated in somewhat simplified form in FIG. is a representative gas-fired forced air heating furnace 10 that incorporates therein a series of uniquely configured $NO_x$ reducing devices 12 (also shown in FIGS. 2-4) embodying principles of the present invention. In a manner subsequently described, the devices 12 function to substantially lower the amount of combustion-generated nitrogen oxides emitted to atmosphere during operation of the furnace 10. Importantly, the devices 10 accomplish this desirable $NO_x$ reduction without appreciably increasing the operational noise level of the furnace, thereby rendering the improved furnace suitable for indoor residential installations where quietness of operation is a key design criteria.

Furnace 10 includes an outer housing structure 14 having a bottom inlet opening 16 and a top outlet opening 18. Horizontal and vertical partition members 20,22 divide the interior of housing 14 into a return air plenum 24 communicating with the inlet opening 16, a supply air flow passage 26 positioned above plenum 24 and communicating with outlet opening 18, and an equipment chamber 28 also positioned above plenum 24 to the left of flow passage 26.

A series of shot-type gas burners 30, each having an outlet 32, are spaced apart in a front-to-rear direction along the bottom of chamber 28, with only one of the burners being visible in FIG. 1 (the remaining burners being behind the single visible burner). Directly above the burners 30 within chamber 28 is a draft inducer fan 34 driven by a motor 36. Fan 34 has an inlet 36 facing the housing flow passage 26, and an upwardly facing outlet 38 connectable to an external exhaust flue 40.

Operatively disposed within the supply air flow passage 26 is a combustion heat exchange structure 42 having a primary heat exchanger portion defined by a horizontally spaced series of generally L-shaped metal combustor tubes 44. Each of the tubes 44 has a horizontally disposed inlet leg portion $44_a$ with an open outer end connected to one of the burner outlets 32, and an upturned outlet leg portion $44_b$ positioned at the right side of the supply air flow passage 26.

The heat exchange structure 42 also includes a secondary heat exchanger section disposed within an upper portion of air flow passage 26 and including an inlet collector box 46 connected to the upper ends of the tube leg sections $44_b$, and an outlet collector box 48 connected to the draft inducer fan inlet 36. The interiors of the inlet and outlet collector boxes 46,48 are communicated by a series of vertically serpentined metal secondary heat exchanger tubes 50 that are horizontally spaced apart in a front-to-rear direction and connected at their opposite ends to the inlet and outlet collector boxes. As illustrated, the tubes 50 have smaller diameters than the tubes 44. Only one of the tubes 50 is visible in FIG. 1, the remaining tubes 50 being positioned behind the single visible tube 50.

During operation of the furnace 10, air 52 is drawn upwardly through the housing inlet 16 into the return air plenum 26 by operation of a centrifugal blower 54 disposed within the plenum. The air 54 enters the blower inlet 56 and is forced upwardly through the supply air passage 26 and discharged through the housing outlet opening 18 for delivery to the conditioned space served by the furnace via a supply duct 58 connected to the housing outlet opening 18.

At the same time, operation of the gas burners 30 creates flames 60 which are drawn into the open left ends of the primary combustion tubes 44 by the operation of the draft inducer fan 34. The flames 60 generate hot combustion gases 62 that the fan 34 sequentially draws through the tubes 44, the inlet collector box 46, the tubes 50, and the outlet collector box 48, and then discharges to atmosphere via the exhaust flue 40. As the air 52 externally traverses the heat exchange structure 42, combustion heat is transferred from the flames 60 and the gases 62 to the air 52 prior to its delivery to the conditioned space served by the furnace 10

Referring now to FIG. 4, each of the $NO_x$ reducing devices 12 includes an identical pair of elongated, relatively thin flat metal plates 64. Each of the plates 64 has a generally rectangular configuration: a pair of opposite end portions 66,68 with widths W; elongated rectangular notches 70 formed in its opposite side edges between its opposite end portions 66 and 68; and a longitudinal slot 72 extending inwardly through its end portion 68 and having an inner end $72_a$ disposed midway along the length of the plate 64.

The device 12 is assembled by simply positioning the plates 64 with their end portions 68 facing one another and the planes of the two plates being transversely oriented (FIG. 4) and then fitting the two plates 64 together, as indicated by the arrow 74, until the slot ends $72_a$ bottom out against one another. In this fitted-together orientation, the two plates 64 are in the longitudinally overlapped, transverse orientation shown in FIG. 3. The device 12 is completed by spot welding the two interfitted plates 64 together, as at 76, adjacent the opposite ends of the device 12.

Figure 3:
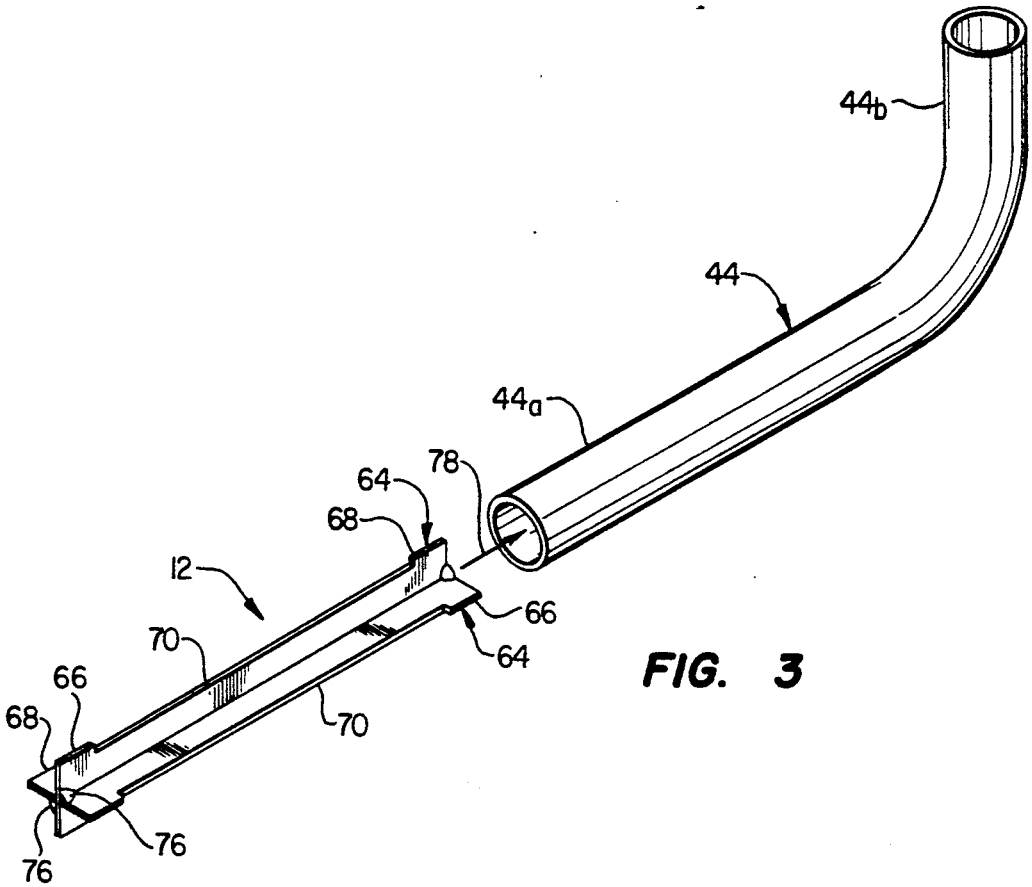
FIG. 3 is an exploded perspective view of one of the primary heat exchanger tubes and an associated one of the $NO_x$ reducing devices.

The completed device 12 is then longitudinally inserted axially into its associated tube section $44_a$ as indicated by the arrow 78 in FIG. 3. The width dimensions D of the plate end portions 66,68 (FIG. 4) are sized in a manner such that the outer side edges of the plate end portions 66,68 of the inserted device 12 are in a generally press-fitted relationship with the interior side surface of the tube section $44_a$.

Figure 2:
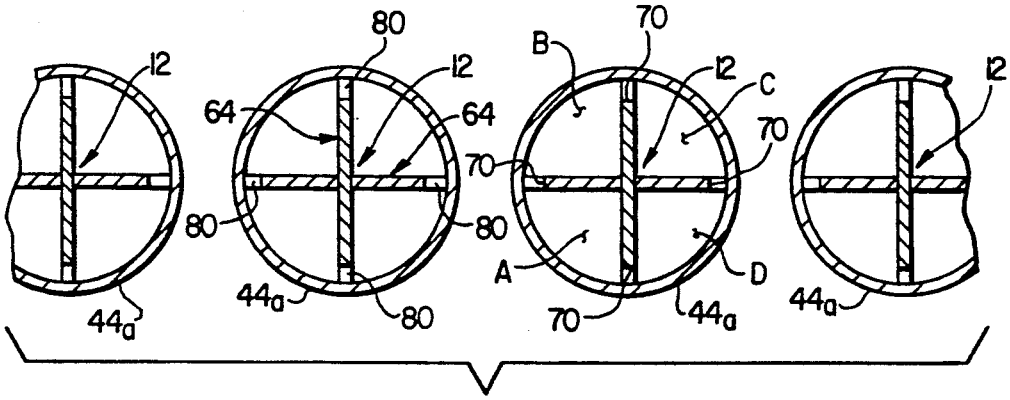
FIG. 2 is a partial cross-sectional view through a primary heat exchanger portion of the furnace taken along line 2—2 of FIG. 1 and illustrating several of the $NO_x$ reducing devices.

As illustrated in FIG. 2, along its axial length, each of the inserted devices 12 divides the interior of its associated tube section $44_a$ into four circumferential sections A,B,C and D. Each such section is bounded by the interior surface of the tube section $44_a$ and a pair of essentially planar boundary surfaces (i.e., side surfaces of two lateral halves of the plates 64) which longitudinally extend parallel to the tube section axis and laterally extend radially outwardly from the tube section axis to positions closely adjacent the interior tube section surface.

During operation of the furnace 10 as previously described, each of the flames 60 being drawn through the primary combustor tubes 44 is initially intercepted in an edgewise fashion by the left or upstream end of the associated device 12, divided, and then caused to flow through the four circumferential segments A,B,C and D of the tube section $44_a$ before exiting the device 12 and entering the tube section $44_b$. Because the device 12 intercepts the flame 60 in an edgewise fashion, the device only minimally disrupts and blocks the flame during furnace operation.

However, because the device divides the flame into four axially flowing segments during its traversal of the device, the resulting flame dispersement substantially reduces the $NO_x$ emission levels of the furnace 10. This $NO_x$ emission reduction is augmented by the thermal quenching of the flame resulting from its heat transfer to the device 10.

A significant advantage arising from the configurations of the devices 12 is that they perform their $NO_x$ reduction functions, namely flame quenching and dispersement, without creating an appreciable operational noise level increase in the furnace 10. Accordingly, the improved furnace 10 is quite suitable for indoor residential installations where operational quietness is a key design criteria. The operational quietness of the $NO_x$ reducing devices 12 is enhanced by the provision of the elongated outer side edge notches 70 which form circumferential passages 80 (FIG. 2), each of which communicates an adjacent pair of the four circumferential tube sections A,B,C and D formed by each of the devices 12 in its associated combustor tube portion $44_a$.

An alternate embodiment $12_a$ of the $NO_x$ reducing device 12 is illustrated in FIGS. 5 and 6 and is formed from two identically configured elongated metal bent plate members 82 and 84, each of which has a generally L-shaped cross section along its length. Member 82 has a pair of transverse legs 86 and 88. A pair of arcuate slots are formed in leg 86, adjacent its juncture with leg 88, and form a pair of tabs 90 that are bent outwardly away from leg 86 to form resulting openings 92 therein. Member 84 has a pair of transverse legs 94 and 96. A pair of arcuate slots are formed in leg 94, adjacent its juncture with leg 96, and form a pair of tabs 98 that are bent outwardly away from leg 94 to form resulting openings 100 therein.

To assemble the $NO_x$ reducing device $12_a$, the members 82,84 are relatively oriented as shown in FIGS. 5 and 6, the tabs 98 are inserted through the openings 92 over the top side of leg 88, and the tabs 90 are inserted in the opposite direction through the openings 100 beneath the leg 96. The tabs 98 are then spot welded, as at 102, to the top side of leg 88, and the tabs 90 are spot welded in a similar manner to the underside of the leg 96.

In a manner similar to that of the previously described device 12, the device $12_a$ has a generally cross-shaped configuration along its length, is axially insertable into one of the combustor tube sections $44_a$, divides the tube section into four axially extending circumferential segments, and intercepts the incoming burner flame in an edgewise fashion to promote operational quietness while providing a substantial reduction in $NO_x$ emissions. However, the device $12_a$ is preferably not laterally sized to be press-fitted into the interior of one of the combustor tube sections $44_a$. Instead, the device $12_a$ is laterally sized to have a relatively loose fit within its associated combustor tube section.

The primary advantage of the device $12_a$ over its counterpart device 12 is that the device $12_a$ is somewhat stronger from a structural standpoint. Although it is not quite as quiet in operation as the device 12, it is still well within the quietness levels required for indoor residential installations.

It can be seen from the foregoing that the present invention provides $NO_x$ reducing apparatus which is quite simple, relatively inexpensive and easy to install in the combustor tube portion of a fuel-fired heating appliance. While the devices 12 and $12_a$ have been illustrated as being incorporated in a furnace, it will be readily appreciated by those of reasonable skill in this particular art that they could also be advantageously be incorporated in fuel-fired heating appliances of other types including, for example, water heaters and boilers.

While it is preferable that the $NO_x$ reducing device of the present invention be provided with a generally cross-shaped configuration along its axial length, other cross-sections could be alternatively utilized if desired. For example, a single diametrically extending plate could be used, although for a given length it would not, of course provide as much $NO_x$ emission reduction. Also, a similar device having a Y-shaped cross section along its length could be used, or a device having more than the illustrated four radially extending leg portions could be used within the scope of the present invention.

The foregoing detailed description is to be clearly understood as being given by way of illustration and example only, the spirit and scope of the present invention being limited solely by the appended claims.

What is claimed is:

1. For use in a fuel-fired heating appliance, heat exchange apparatus comprising:

a generally tubular combustor member having a first longitudinal portion adapted to internally receive a flame through an outer end thereof, said first longitudinal portion circumscribing an axis and having an essentially constant interior diameter along its length, and a second longitudinal portion adapted to discharge combustion gases, generated by the received flame, through an outer end thereof; and NOx reducing means, disposed within and extending axially along said first longitudinal combustor member portion, for reducing the NOx level of the discharged combustion gases by dispersing and thermally quenching the received flame, said NOx reducing means being operative along its axial length to divide the interior of said first longitudinal combustor member portion, along generally planar boundary surfaces extending radially outwardly from said axis, into a plurality of circumferential segments, said NOx reducing means having a relatively thin leading edge portion configured and position to initially intercept the received flame with minimal disruption thereof, said NOx reducing means having generally plate-like portions which radially outwardly extend from said axis and define said boundary surfaces, each of said generally plate-like portions having upstream and downstream end portions which press-fittingly engage the interior surface of said first longitudinal combustor member portion, said generally plate-like portions having leading edges which combinatively defines said leading edge portion of said NOx reducing means, said generally plate-like portions further having radially outer side edge notches formed therein and extending from their upstream end portions to their downstream end portions, each of said radially outer side edge notches defining a passage through which a pair of said circumferential segments communicate, said radially outer side edge notches functioning to diminish noise created by said NOx reducing means during operative combustion product flow through said combustor member.

2. The heat exchanger apparatus of claim 1 wherein:

said NOx reducing means are operative along their axial length to divide the interior of said first longitudinal combustor member portion into four circumferential segments.

3. The heat exchanger apparatus of claim 2 wherein:

said four circumferential segments are substantially identically sized.

4. A NOx reducing device extending along an axis and being axially insertable into an essentially constant interior diameter section of an inlet portion of a combustor tube of a fuel-fired heating appliance, said device being formed from a relatively rigid, heat conductive material and comprising:

a plurality of generally planar, plate-like leg portions circumferentially spaced apart around said axis and lying in planes extending generally radially outwardly from said axis, said leg portions having outer side edge portions with opposite end sections configured to be brought into press fit engagements with the interior surface of said essentially constant interior diameter section of the combustor tube when said device is operatively inserted into the combustor tube, each of said outer side edge portions having a noise reducing notch formed therein and extending between said opposite end sections thereof; and a relatively thin leading edge portion combinatively defined by end edge portions of said leg portions.

5. The NOx reducing device of claim 4 wherein:

the number of said leg portions is four.

6. The NOx reducing device of claim 4 wherein:

said leg portions are equally spaced about said axis.

7. The NOx reducing device of claim 4 wherein:

said device is formed from first and second longitudinally overlapping elongated plate members transversely secured to one another, said first plate member having a first end portion through which a first longitudinal slot inwardly extends to a longitudinally intermediate portion of said first plate member, and a second end portion, said second plate member having a first end portion through which a second longitudinal slot inwardly extends to a longitudinally intermediate portion of said second plate member, and a second end portion, said first longitudinal slot receiving said second end portion of said second plate member, and said second longitudinal slot receiving said second end portion of said first plate member.

8. The NOx reducing device of claim 4 wherein said device includes:

first and second elongated bent plate members each having a generally L-shaped cross section along its length defined by a pair of transverse leg sections, a longitudinally spaced plurality of laterally outwardly projecting tabs, and a longitudinally spaced plurality of openings formed through one of said transverse leg sections adjacent said tabs, said plate members being in a parallel relationship with the tabs of each plate member extending through the openings in the other plate member, and means for fixedly securing the tabs of each plate member to the other plate member.

9. A fuel-fired forced air heating furnace comprising:

a housing;

blower means for forcing air to be heated through said housing;

heat exchanger means, disposed in said housing, for transferring combustion heat to air internally traversing said housing, said heat exchanger means including combustor tube means with an inlet portion for receiving flames, and resulting combustion gases, from a source thereof;

burner means for delivering a flame to said inlet portion of said combustor tube means;

draft inducer fan means for drawing the burner flame and resulting combustion gases through said combustor tube means; and NOx reducing means, disposed within and extending axially along said combustor tube means inlet portion, for reducing the NOx level of combustion gases discharged from said heat exchanger means by dispersing and thermally quenching the received flame, said NOx reducing means being operative along its axial length to divide the interior of said inlet portion of said combustor tube means, along generally planar boundary surfaces extending radially outwardly from said axis, into a plurality of circumferential segments, said NOx reducing means having a relatively thin leading edge portion configured and positioned to initially intercept the received burner flame with minimal disruption thereof, said NOx reducing means having generally plate-like portions which radially outwardly extend from the axis of said inlet portion of said combustor tube means and define said boundary surfaces, each of said generally plate-like portions having upstream and downstream end portions which forcibly engage the interior surface of said inlet portion, said generally plate-like portions having leading edges which combinatively define said leading edge portion of said NOx reducing means, said generally plate-like portions further having radially outer side edge notches formed therein and extending from their upstream end portions to their downstream end portions, each of said radially outer side edge notches defining a passage through which a pair of said circumferential segments communicate, said radially outer side edge notches functioning to diminish noise created by said NOx reducing means during operative combustion product flow through said combustor tube means.

* * * * *

UNITED STATES PATENT AND TRADEMARK OFFICE

CERTIFICATE OF CORRECTION

PATENT NO. : 5,146,910

DATED : September 15, 1992

INVENTOR(S) : Keith M. Grahl and Larry R. Mullens

It is certified that error appears in the above-identified patent and that said Letters Patent is hereby corrected as shown below:

Column 3, line 1, "are" should be --art--.

Column 3, line 28, "FIG." should be --FIG. 1--.

Column 3, line 36, "10" should be --12--.

Column 4, line 40, ":" should be --;--.

Column 7, line 5, "defines" should be --define--.

Signed and Sealed this

Twenty-eighth Day of September, 1993

Bruce Lehman

*Attest:*

BRUCE LEHMAN

*Attesting Officer*

*Commissioner of Patents and Trademarks*